United States Patent [19]

De Roeck et al.

[11] 4,059,241

[45] Nov. 22, 1977

[54] AIR FLOTATION TURNER BAR

[75] Inventors: Joseph Irma De Roeck, St. Katelijne-Waver; Francois Jean Pira, Edegem, both of Belgium

[73] Assignee: AGFA-GEVAERT N.V., Mortsel, Belgium

[21] Appl. No.: 527,521

[22] Filed: Nov. 27, 1974

[30] Foreign Application Priority Data

Nov. 29, 1973 United Kingdom ..... 55390/73

[51] Int. Cl.[2] ..... B65H 59/00

[52] U.S. Cl. ..... 242/75.5; 242/76; 226/97; 226/196; 308/DIG. 1

[58] Field of Search ..... 226/7, 97, 196, 197; 308/DIG. 1, DIG. 9, 108; 34/156; 242/75.5, 76

[56] References Cited

U.S. PATENT DOCUMENTS

| | | | |
|---|---|---|---|
| 2,736,106 | 2/1956 | Offen | 34/156 |
| 3,127,080 | 3/1964 | Allander et al. | 226/97 |
| 3,313,462 | 4/1967 | Smith, Jr. | 226/97 |

OTHER PUBLICATIONS

Streeter, P. N.; IBM Tech. Disclosure Bulletin, vol. 4, No. 9, Feb. 1962.

*Primary Examiner*—Allen N. Knowles
*Attorney, Agent, or Firm*—William J. Daniel

[57] ABSTRACT

An air flotation turner device for a travelling web, wherein a web-supporting air cushion is established between a convexly curved imaginary surface of the device and a concavely curved surface of the web.

8 Claims, 6 Drawing Figures

AIR FLOTATION TURNER BAR

The present invention relates to an air flotation turner device for a travelling web.

In the conveyance of webs of material parallel with their longitudinal axis, air flotation turner bars are used to alter the direction of travel of the webs of material through an angle up to 180 angular degrees. Air is forced through an array of apertures in the peripheral surface of the turner bar so that a cushion of air is established and maintained between the curved surface of the turner bar and the web material so preventing the web material from touching the surface of the bar. These air flotation bars are of particular use when the surface of the web material is covered with a wet coating or any other coating which is liable to be damaged on contact. For example, air flotation turner bars may be used in the handling of long lengths of photographic film in the coating and drying of light-sensitive and other layers.

Various designs of air flotation turner bars are used, but they suffer in general from the following disadvantages.

The construction is expensive as a consequence of the many apertures which must be drilled or milled at determined angles in the peripheral surface of the air turner bar.

The perforated peripheral wall of the turner bar may raise problems of thermal expansion if the air which is blown through the apertures is heated in order to contribute to the drying of a web which is being conveyed over the turner bar.

Accidental variations in the web tension or in the air pressure of the turner bar may be the cause of harmful contact between moist web portions and surfaces of the air turner bar.

It is the object of the present invention to provide an air flotation turner device which does not show the deficiencies mentioned hereinbefore, and it is particularly the object of the present invention to provide an air flotation turner device wherein any incidental contact between the web and the device is limited to marginal portions only of the web.

According to the present invention there is provided a turner device for providing support for a travelling web at a zone along its path where it undergoes a directional change, said device comprising means defining an air box or plenum with an unobstructed air discharge mouth at the opposed ends of which there are wall portions having surfaces which are curved to conform with the curvature of the web path at said zone and which when the device is in use lie behind the concavely curved face of the web at opposed marginal portions thereof; and at least one inlet through which air can be continuously forced into said box or plenum so that at said zone the web can be supported out of contact with said device by the air which discharges from said mouth against the concave side of the web while lateral escape of air from behind the web margins takes place between such margins and said curved surfaces.

The invention includes apparatus for transporting a web along a path which is parallel with the longitudinal axis of the web and which undergoes at at least one zone a change of direction in a plane normal to the faces of the web, characterized in that at the or at least one said zone there is a turner device as above defined.

The invention also includes any process of handling or treating a web, particularly photographic film, involving the progressive and continuous travel of the web along a path which is parallel with the longitudinal axis of the web and which at at least one zone undergoes a change of direction in a plane normal to the faces of the web, characterized in that at the or at least one said zone there is a turner device according to the invention as above defined, and air is blown through the air box or plenum of such device to keep the concave face of said web face from contact with mechanical parts at said zone or to keep the web face from any such contact other than incidental contact at its marginal portions with said curved surfaces. This method is particularly important in the coating and drying of photographic film.

In certain embodiments of the invention the turner device comprises two parallel end walls, rims on the innerside surfaces of said end walls which are curved about a common axis and which determine an imaginary curved surface extending between said rims, at least one entry opening for connection to a supply of pressurized air for establishing an overpressure of air in the space which is determined by said end walls and said imaginary curved surface, and means for moving a web over said turner device so that the web margins partially overlie the rims while, however, remaining separated therefrom as a consequence of the air which is supporting the web over the said imaginary curved surface and which is laterally escaping under the web margins which overlie the said rims.

Hereafter in the description of further features and specific embodiments of the invention the device will be referred to as a turner "bar" but it will be clear that the device unlike the known devices does not have the physical form of a bar.

Preferred embodiments of the air flotation turner bar according to the invention are as follows.

Arcuate edge guides closely fit on the outside surfaces of said rims and are mounted for limited displacement in a plane which is parallel to said end walls.

The end walls and the rims of the turner bare are circularly curved through 360° about said common axis, and the said rims are arranged for free rotation about said common axis.

Web constraining means are provided between the end walls to prevent a web from being accidentally drawn between said end walls up to said common axis.

The invention will be described hereinafter, by way of example, with reference to the accompanying drawings, in which.

Figure 1:
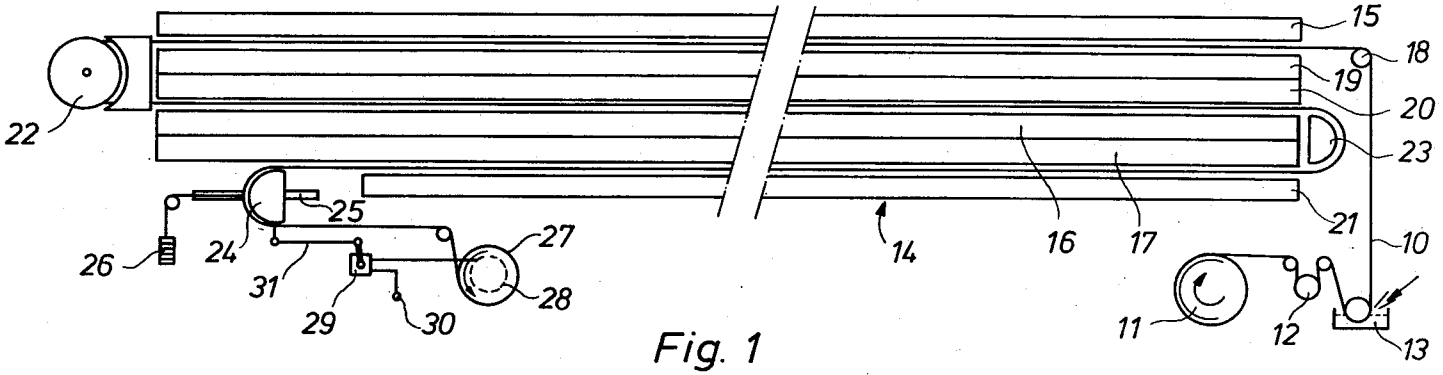
FIG. 1 is a diagrammatic illustration of an installation for the coating and the drying of a web.

Referring to FIG. 1, a web 10 is pulled from a supply roll 11 by means of a roller 12 controlling the speed of the web, and passed through a coating station 13, for instance an air-knife coater, for the application of a wet layer of a coating composition to the web. The web is passed over an idler roller 18 through an air flotation drying station 14 which comprises elongate chambers such as the chambers 15, 16 and 17 which cover over the full width the web and which are provided at their sides adjacent to the web path with a plurality of slots through which heated air is blown for the purpose of drying the wet layer applied to the web. The drying station 14 further comprises chambers 19, 20 and 21, which may be similar in construction to the chambers 15 to 17, but which are connected to separate sources of pressurized air, not shown, for the establishing of air cushions which counterbalance the forces on the web caused by the web-drying air currents.

The cross-over for the web from the chamber 19 to the chamber 20 is formed by an air flotation turner bar 22 whereas the cross-over from the chamber 16 to the chamber 17 is formed by an air flotation turner bar 23. Finally, there is provided an air flotation turner bar 24 which is mounted for displacement on a rail 25 in a direction parallel to the web path and which is biased by weights 26 so as to control the tension of the web on its path after the roller 12. The dried web is wound on a roll 27 which is driven by a motor 28 shown in broken lines which is controlled by a controller 29 which controls the current delivered by an electric supply source 30. The controller 29 is signalled by the position of the air flotation turner bar 24 through an appropriate connection such as the lever connection 31, and in consequence the turner bar 24 functions as a so-called dancer roller, controlling the winding rate of the web.

In the illustrated embodiment, the coating is limited to one surface of the web and in consequence the air flotation turner bar 22 is not strictly required since it faces the dry web side which might as well be guided by one or more conventional idler rollers. In the case a web provided with a wet coating on both its sides must be dried, the roller 18 should be replaced by an additional air flotation turner bar.

Figure 3:
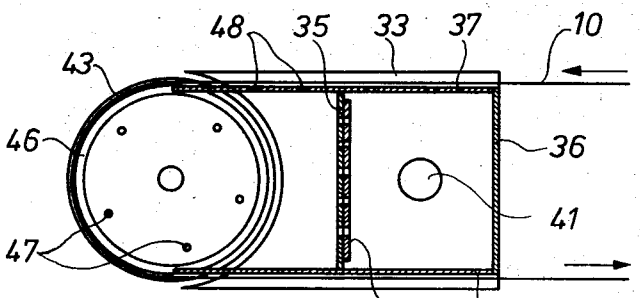
FIG. 3 is a longitudinal vertical sectional view of the air flotation turner bar according to FIG. 2.
Figure 2:
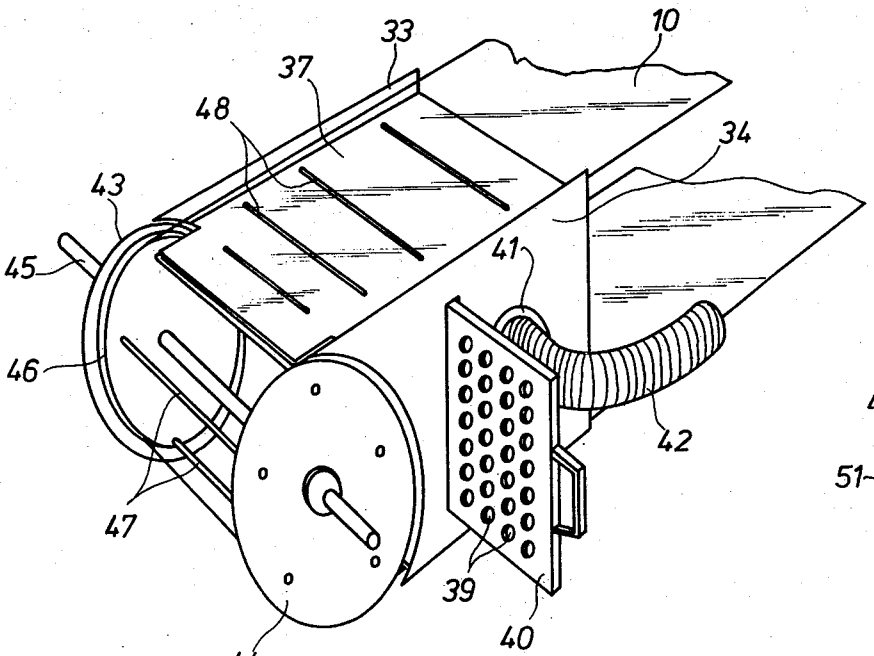
FIG. 2 is a perspective view of the air flotation turner bar 22 according to FIG. 1.

The air flotation turner bar 22 is illustrated in detail in FIGS. 2 and 3. The turner bar comprises a boxlike housing which has lateral end walls 33 and 34, front and rear walls 35 and 36, and top and bottom walls 37 and 38. The spacing between the end walls 33 and 34 is slightly greater than the width of a web 10 being turned, and said end walls also slightly project beyond the top and the bottom walls 37 and 38. The top wall 37 is provided with openings, such as the slots 48 illustrated. The front wall 35 is provided with a plurality of circular openings which may mesh with corresponding openings 39 in a baffle 40 which is arranged for slight lateral displacement. The baffle has been illustrated in FIG. 2 in an almost completely withdrawn position for illustrative purposes, but it will be understood that actually the baffle will be completely inserted in the housing and will be laterally moved over a distance which equals the diameter of one opening 39 only, such displacement enabling an adjustment of the wall 35 from a fully opened to a fully closed position. One lateral end wall e.g. 34 is provided with an opening 41 which is connected through a flexible conduit 42 with a source of pressurized air, not shown.

The proper web turning part of the turner bar is formed by two parallel discs 43 and 44 which are fixedly mounted on a shaft 45 which is free rotatably supported in bearings, not shown.

The distance between the innerside surfaces of the discs equals the distance between innerside surfaces of the end walls 33 or 34, and the discs further match with the concavely curved extremities of the end walls 33 and 34, thereby leaving a curved gap with a width from 1 to 3 mm. Each disc is provided at its innerside surface with a circular rim 46, the axis of which coincides with the axis of the discs, the diameter of which equals about the distance between the outer surfaces of the walls 37 and 38, and the width of which is sufficiently great in order that the marginal portions of the web should overlie part of the width of said rims. The rims may be formed by rings as illustrated in FIG. 3 and the mounting of which will be further disclosed in the description referring to FIG. 5, but they may also be formed by the periphery of another, smaller, disc which is fitted to the innerside surface of each of the discs 43 and 44. A set of five equally angularly spaced rods 47 is mounted between the discs 43 and 44 for preventing a web from being accidentally drawn between the discs.

The end portions of the top and bottom walls 37 and 38 at the side of the discs are slightly narrowed thereby to freely extend between the rims 46.

In the operation of the described air flotation turner bar, a web 10 is being supported during its turning over 180 angular degrees by a cushion of air which is established by pressurized air in the space which is determined by the discs 43 and 44, and the walls 33, 34, 35, 37 and 38. The web margins which partially overlie the rims 46 remain separated therefrom as a consequence of the air which is supporting the central web portion which extends between said overlying web margins. The air laterally escapes between the web margins and the rims, and it is shown that an extremely stable transport of the web over the air flotation turner bar occurs. The distance separating the web margins from the rims may vary between 2 and 10 mm and, depending on the web tension, the web curvature, the pressure of the air at the opening 41, and the setting of the baffle 40, this distance may even be greater. The width over which each web margin overlies the corresponding rim should amount to at least about 2 mm. The free distance between the web edges and the innerside surfaces of the turner bar is not critical but it should be in any way sufficiently great to allow slight variations of the width and of the lateral position of the web.

The free distance between the rims of both discs is not critical. The only condition which is important is that a web which, for one reason or other, contacts with one edge a lateral guide surface of the turner bar, still covers with its margin at the opposite edge the corresponding rim of the turner bar over a distance of at least about 2 mm.

The rotatable mounting of the air flotation turner bar is useful when, for instance as a consequence of increased web tension or of a deficient air supply, the web margins should touch the rims of the discs. In such case the discs, which are immobile in normal operation, are dragged by contact of the web margins with the rims so that rolling friction occurs between the web and the turner bar, rather than sliding friction.

The rods 47 which extend between the discs 43 and 44 have two functions. First, to prevent that a web is accidentally pulled up to the shaft 45. Thus, a web which is overtensioned to such an extent that it slips from the rims 46 and is pulled between the discs, is withheld by the constraining rods. The described arrangement may injure the web but it has the advantage that, in a way simular as described for the rims 46, rolling friction is introduced at accidental operation so that rupturing of the web which would very likely occur in the absence of such web constraining means, may be avoided. A second function of the rods 47 is to assist in pulling a web, or as the case may be a leader band, through the installation during a starting procedure or after accidental rupturing of the web.

Figure 5:
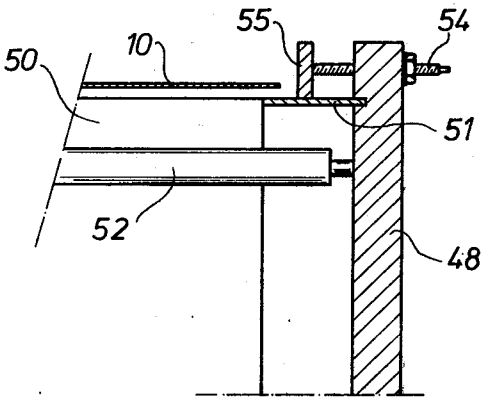
FIG. 5 is a partial vertical sectional view of the air flotation turner bar according to FIG. 4.
Figure 4:
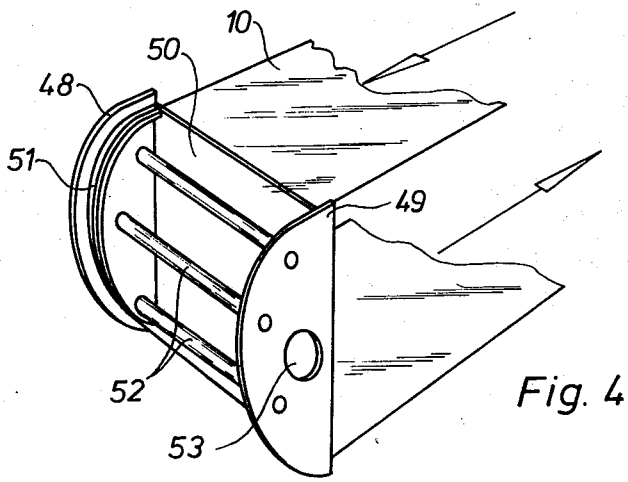
FIG. 4 is a perspective view of the air flotation turner bar 23 according to FIG. 1.

The air flotation turner bar 23 of the installation is illustrated in detail in FIGS. 4 and 5. The turner bar comprises two parallel end walls 48 and 49 that are generally half-circularly shaped, and that are joined by a vertical rear wall 50. The innerside surfaces of the end walls are each provided with a rim 51 which consists of a half-circular ring which is fitted in a corresponding groove in the wall as is illustrated on an enlarged scale for the wall 48 in FIG. 5. Three freely rotatable rollers 52 are provided which perform the same function as the constraining means 47 described hereinbefore. Finally, one end wall is provided with an opening 53 for connection of the device to a supply of pressurized air (FIG. 4).

The normal operation of the foregoing device does not differ from that of the device illustrated in FIGS. 2 and 3, a web 10 being supported over an angle of about 180 degrees on an air cushion, and the marginal portions of the web 10 overlying the rims while remaining separated therefrom. In the case of unbalance of forces whereby the web would tend to be pulled between the end walls 48 and 49, the web first enters with its marginal portions into contact with the rims 51. This sliding friction may damage the marginal portions of the web but it may not be capable of increasing the web tension to such an extent that rupturing of the web would occur. The risk for web rupturing does exist in case the web would be completely pulled between the end walls, but this situation is prevented by the rollers 52 which enter into rolling contact with a web as, at still increasing tension, it slides off the rims and is pulled between the discs.

The air flotation turner bar according to the invention may be further provided with displaceable edge guides such as a guide 55 illustrated in FIG. 5. Such a guide is preferably circularly curved to fit with its lower surface onto the rim 51, and may be connected to an end wall such as the wall 48 by means of adjustment screws 54 which are spaced over equal angular intervals and which permit an adjustment of the edge guide in a plane parallel to that of the end walls. The mentioned edge guides permit to control the lateral position of a web in the device and they are particularly useful in an air flotation turner bar wherein relatively wide, for instance wider than 5 cm, rims are used so that webs of slightly differing widths may be used. In such circumstances it may occur that a relatively narrow web, if abutting with an edge against one end wall, no longer covers, with the marginal portion at its opposite edge, the corresponding rim of the opposite end wall of the device so that the symmetry of the web-supporting air cushion is destroyed. The appropriate adjustment of edge guides may limit intolerable lateral deviations of a web from its path.

Air flotation turner bar 23 in the installation (FIG. 1) serves for the purpose of turning a web while a freshly coated layer on the web faces the turner bar. It will be understood that the air which is used for establishing the web-supporting air cushion may also be heated or cooled in order to assist in the drying or the gelling of the web coating.

The air flotation turner bar 24 which is shown in FIG. 1 is substantially the same device as the turner bar 23, except for its displaceable mounting on a horizontal guide rail 25 as described already hereinbefore, which enables the air flotation turner bar to operate as a dancer roller. The load of the weight 26 determines the web tension whereas the bodily position of the turner bar controls the winding of the web.

It will be understood that the present invention is not limited to the described embodiments.

Thus the end walls of a stationary air flotation turner bar such as the bar 23 may also have a rectangular rather than a half circular shape as shown in the figures. They may also form the continuation of the side walls of the chambers 16 and 17 of the drying station and in such case there may be no air inlet through an opening 53, but rather through appropriate openings provided in the transverse wall 50 so that pressurized air of the chambers 16 and 17 may be used to create the web supporting air cushion in the air flotation turner bar.

Figure 6:
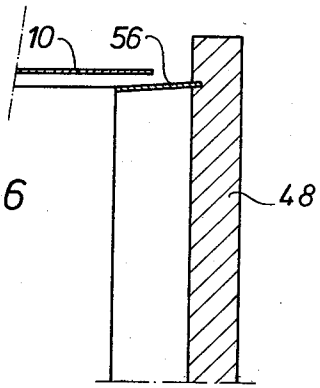
FIG. 6 is an illustration of a modified rim on the innerside surface of an end wall of a turner bar.

The rims of an air flotation turner bar according to the invention may have an outer peripheral surface 56 that is conically tapered towards that of the opposite rim as illustrated in FIG. 6, in order to obtain a self-centering effect on a web 10 which is being conveyed over the turner bar.

Other web constraining means such as a mesh or the like may be provided between the end walls of the air flotation turner bar in a curved plane which is well below the curved plane which is determined by the rims, in order to limit web displacements towards the center of the turner bar on accidental operation of the turner bar.

Leakage of pressurized air through the curved gap between the discs 43, 44 and the corresponding lateral end walls 33, 34 of the apparatus according to FIG. 2 may be reduced by providing a labyrinth type air trap between the mutually facing surfaces.

The air flotation turner bar according to the invention may be used in conjunction with a web centering device for correcting the sidewise drift of a web. Such devices are known in the art and comprise one or more rollers about which the web is pulled and which are mounted on a frame which may be tilted to make a deviating web move towards the desired location. The use of one or more web centering devices in an installation of a type as illustrated in FIG. 1 may be imperative in a number of cases, since in the absence of the laterally constrained forces which are produced by the contact of the web with a plurality of web guiding rollers in a conventional web guiding and supporting installation, the web is more free to deviate from its intended path.

Finally, the position of the air flotation turner bar according to the invention may be rotated through 90° angular so that also vertically running webs may be turned, and the imaginary web supporting surface of the turner bar may cover less than 180° angular so that, for instance, the direction of a running web may be changed from the horizontal to the vertical, or vice versa.

We claim:

1. A turner device for providing support for a travelling web within a zone along its path where it undergoes an arcuately curved directional change, said device comprising means defining an air plenum including two opposed spaced apart generally solid side walls extending perpendicularly to the plane of the web in adjacent spaced relation to the extreme web edges, opposed arcuately curved flanges each formed integrally with one such side wall and projecting inwardly therefrom for underlying limited overlapping relation with the corresponding marginal strips of the web passing between the planes of said side walls, said flanges being coaxially arranged with their curvature corresponding to the curvature of the web directional change, the mutually facing edges of said flanges being spaced apart a distance equal to the transverse width of said web less said marginal strips and the intervening space being substantially open and unobstructed to leave the web substantially unsupported in said intervening space, means for supplying air to said plenum under pressure sufficient to provide during travel of the web an air cushion below the curved web portion to support the web while undergoing said directional change, and web constraining means within said plenum for preventing the web from being accidentally drawn as far as the center of curvature of said curved flanges.

2. An air flotation turner device according to claim 1, wherein the periphery of said side walls is circularly curved coaxially with said flange.

3. An air flotation device according to claim 1, wherein said web constraining means are in the form of stationary rods that run parallel to the axis of curvature of said flanges.

4. An air flotation device according to claim 1, wherein said web constraining means are in the form of rollers that are freely rotatable about an axis parallel to the axis of curvature of said flanges.

5. An air flotation device according to claim 1, wherein the side walls have exteriorly projecting portions which are mounted for displacement laterally of the web path.

6. An air flotation turner device according to claim 1, including means mounting said plenum for displacement in a direction generally away from that of the entering and the leaving web, and means for biasing said plenum in such direction.

7. An air flotation turner device according to claim 6, wherein said plenum is operatively coupled to means for controlling the winding speed of the web in response to the displacement thereof, thereby to function as a dancer roller.

8. A turner device for providing support for a travelling web within a zone along its path where it undergoes an arcuately curved directional change, said device comprising means defining an air plenum including two opposed spaced apart generally solid side walls extending perpendicularly to the plane of the web in adjacent spaced relation to the extreme web edges, opposed arcuately curved flanges each formed integrally with one such side wall and projecting inwardly therefrom for underlying overlapping relation with the corresponding margin of the web passing between said side walls, said flanges being coaxially arranged with their curvature corresponding to the curvature of the web directional change and extending around 360° angular, said side walls and said flanges being mounted for free rotation about their common axis, said plenum having a substantially unobstructed opening between said flanges whereby said web is substantially unsupported in the region therebetween, and means for supplying air to said plenum under pressure sufficient to provide during travel of the web an air cushion between the web margins and the adjacent flange surfaces and support the web between said end walls while undergoing said directional change.

* * * * *